United States Patent [19]

Morgan, Sr.

[11] 4,145,789

[45] Mar. 27, 1979

[54] PAINT DISTRIBUTING PLATE

[75] Inventor: Robert E. Morgan, Sr., Bordentown Township, N.J.

[73] Assignee: Mark L. Luther, Yardville, N.J. ; a part interest

[21] Appl. No.: 807,580

[22] Filed: Jun. 17, 1977

[51] Int. Cl.[2] ..... A46B 17/02; B44D 3/12; B65D 25/08

[52] U.S. Cl. ..... 15/257.06; 220/22; 220/90; 248/111

[58] Field of Search ..... 15/257.05, 257.06, 260, 15/261, 263, 264; 68/229; 206/361, 362, 15.1 B; 220/22.1, 90, 22, 22.3; 248/110–113; 210/467, 469

[56] References Cited

U.S. PATENT DOCUMENTS

| | | | |
|---|---|---|---|
| 475,429 | 5/1892 | Zeiser | 15/264 |
| 486,919 | 11/1892 | Winget | 220/22.2 |
| 2,192,526 | 3/1940 | Rosenberger | 248/110 |
| 2,198,059 | 4/1940 | Pistorius | 210/469 |
| 2,258,524 | 10/1941 | Vigurs | 210/467 |
| 2,521,122 | 9/1950 | Lambourne | 15/257.06 |
| 2,645,127 | 7/1953 | Parks | 220/22.3 X |
| 2,893,030 | 7/1959 | Averna | 15/257.06 |
| 2,932,838 | 4/1960 | Ovellette | 15/257.06 |
| 3,661,351 | 5/1972 | Olsen | 248/110 X |
| 3,729,764 | 5/1973 | Vines | 15/257.06 |
| 3,837,034 | 9/1974 | Leffert et al. | 15/257.06 |
| 3,980,213 | 9/1976 | Ramsay | 220/90 |

FOREIGN PATENT DOCUMENTS

| | | | |
|---|---|---|---|
| 533467 | 12/1954 | Belgium | 15/257.06 |
| 45527 | 2/1966 | German Democratic Rep. | 15/257.06 |
| 277093 | 11/1951 | Switzerland | 15/257.06 |

*Primary Examiner*—Daniel Blum

*Attorney, Agent, or Firm*—Samuel Louis Sachs

[57] ABSTRACT

A paint distributing plate for insertion into an open mouthed receptacle such as a paint bucket or the like including a planar sheet dimensioned for insertion into the receptacle, the planar sheet dividing the receptacle into two compartments and means for locking the planar sheet in a selective position within the receptacle. The planar sheet provides a surface against which a paint brush or roller may be wiped to evenly distribute paint thereon.

41 Claims, 7 Drawing Figures

PAINT DISTRIBUTING PLATE

BACKGROUND OF THE INVENTION

1. Field of the Invention

The present invention relates to devices for distributing paint on and saturating paint brushes and rollers and more particularly, to a distributing plate which is adapted for insertion into an open mouthed receptacle.

2. Description of the Prior Art

The desirability of effecting a properly distributed quantity of paint upon a paint roller or paint brush is well known in the painting arts. The simplest method of attaining this goal is accomplished by the dipping of a paint brush or a paint roller into a receptacle containing paint. Unfortunately this usually does not properly distribute the paint upon the painting implement. Consequently, the roller or paint brush must be wiped against a suitable surface so that the paint is properly distributed thereon. The crudest method of distributing paint upon a paint brush or roller is the wiping thereof against the mouth of the receptacle which contains the paint. This method has proven to be highly unsatisfactory.

U.S. Pat. No. 2,919,828 issued to C. B. Lemke on Jan. 5, 1970 discloses a combination paint brush scraper and shaper which comprises an elongated sheet of material having diverging end portions with the extremities thereof bent laterally with respect to the end portions. The end portions provide depending outside legs for engaging the edge of a paint can. While this apparatus may provide an adequate surface for the wiping of a paint brush, it is entirely inadequate for a paint roller.

U.S. Pat. No. 2,827,648 issued to H. F. Geisz on Mar. 25, 1928 shows a substantially planar member having a plurality of corrugations and a pair of edges which are bent so that they are substantially perpendicular to the corrugated surface. This apparatus is intended to rest within a paint can and no means are shown or suggested for fixing the structure to the paint can. As a result, if the paint can is tilted or if a paint roller is pressed against the apparatus of Geisz the apparatus will be disturbed within the paint can to a point where tilting is inevitable.

Similarly, U.S. Pat. No. 2,893,030 issued to C. J. Averna on July 7, 1959 discloses a plate having a plurality of rigid ribs integrally formed therewith and a top horizontal shelf which is bent from the plate and provides a pair of vertical ears adjacent to the corners thereof. The shelf and ears are placed over the edge of a paint can to suspend the plate in position. However, if the paint can is tilted, when carried by the user, no means are shown or suggested for locking the plate in position. Therefore, the plate will tip within the can causing paint to splash thereout. Also, possible disengagement of the horizontal shelf and ears from the lip of the can may result from moderate tilting.

U.S. Pat. No. 2,705,334 issued to L. H. Farrow on Apr. 5, 1955 teaches a paint roller wiping device for use in conjunction with a paint bucket or the like. The device includes a substantially semi-circular shelf which is suspended from a bracket that engages the edge of the bucket. The shelf is provided with a downwardly and outwardly extending portion and includes a pair of inwardly bent ears at each end thereof. A substantially flat plate is positioned intermediate to the ears of the semi-circular shelf and is extended downward therefrom to the base of the paint bucket. The shelf in conjunction with the plate and the walls of the bucket form a paint brush chamber. The apparatus of Farrow requires two separate elements, which must be assembled i.e., a semi-circular shelf and a plate which is bent into a desired shape. The bracket that engages the edge of the bucket contacts the same at only one point and thereby provides only minimal stability to the device of Farrow when a paint roller is actively wiped thereagainst. Furthermore, the ears of the semi-circular shelf which engage the plate of Farrow hinge upon the wiping surface of the device and therefore can cause uneven distribution of paint upon a paint roller.

The present invention overcomes the problems associated with the prior art by providing a paint distributing plate which is simple in design yet locks into position when placed into an open mouthed receptacle such as a paint can or the like regardless of the tilting of the receptacle.

SUMMARY OF THE INVENTION

Therefore, a primary object of the present invention is to provide a paint distributing plate for insertion into an open mouthed receptacle which is locked into position when inserted therein.

A further object of the present invention is to provide a paint distributing plate for insertion into an open mouthed receptacle wherein the plate will not float in the paint disposed within the receptacle.

A still further object of the present invention is to provide a paint distributing plate for insertion into an open mouthed receptacle which is ideally suited for distributing paint on both paint rollers and paint brushes.

Still another object of the present invention is to provide a paint distributing plate which includes means for storing paint brushes of various sizes and shapes.

Another further object of the present invention is to provide a paint distributing plate which permits passage of paint therethrough so that paint disposed within an open mouthed receptacle used in cooperation with the paint distributing plate will remain a homogeneous mixture.

Another still further object of the present invention is to provide a paint distributing plate which may be easily divested of accumulating dry paint.

Another object of the present invention is to provide a paint distributing plate which is simple in design, inexpensive to manufacture, and durable.

These objects, as well as further objects and advantages, of the present invention will become readily apparent after reading the description of a non-limiting illustrative embodiment and the accompanying drawing.

A paint distributing plate for insertion into an open-mouthed receptacle according to the principles of the present invention includes a planar sheet dimensioned for insertion into the receptacle, the sheet dividing the receptacle into two compartments; and means for locking the planar sheet in a selected position within the receptacle.

BRIEF DESCRIPTION OF THE DRAWING

In order that the present invention may be more fully understood it will now be described, by way of example, with reference to the accompanying drawing in which.

DESCRIPTION OF THE PREFERRED EMBODIMENT

Figure 1:
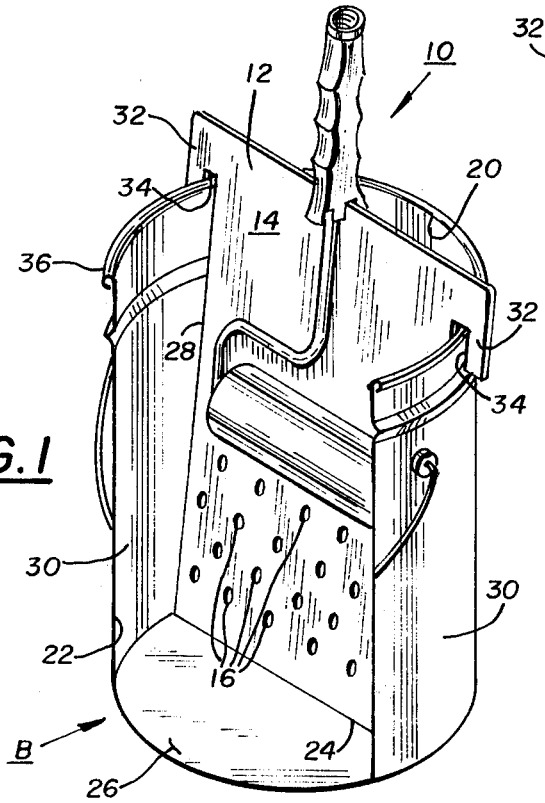
FIG. 1 is a pictorial representation of the preferred embodiment incorporating the principles of the present invention therein installed in a paint can.
Figure 3:
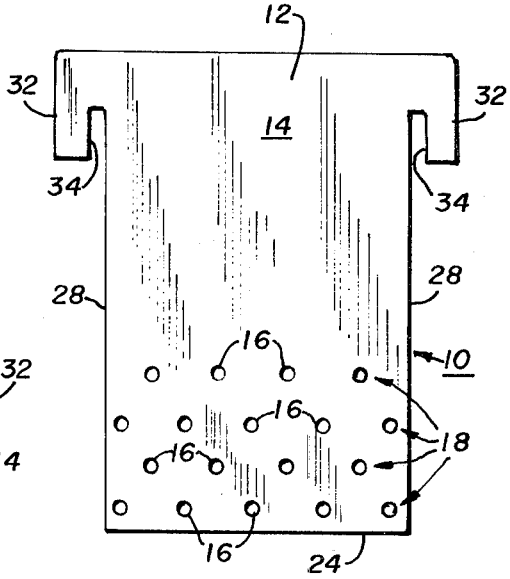
FIG. 3 is a plan view of the preferred embodiment.
Figure 2:
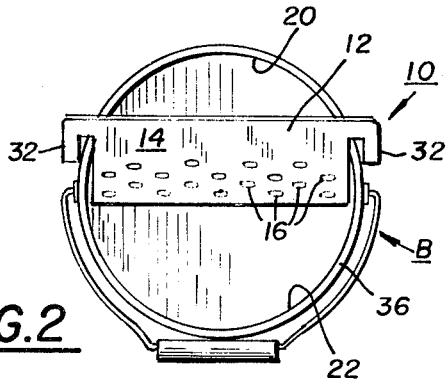
FIG. 2 is a top perspective view of the preferred embodiment installed in the paint can of FIG. 1.

Referring now to the figures, and more particularly to FIGS. 1, 2, and 3 thereof, there is illustrated therein a paint distributing plate 10. The paint distributing plate 10 is illustrated installed in a paint bucket B. Although a paint bucket B is used for purposes of illustration, the paint distributing plate 10 may also be installed in any type of open mouthed receptacle such as a bucket or the like. The paint distributing plate 10 includes a planar sheet 12 which, by definition, is disposed entirely within a single plane. The planar sheet 12 provides a smooth surface 14 against which a paint roller or paint brush may be wiped to evenly distribute paint thereon.

A plurality of apertures 16 are disposed through the planar sheet 12 and permit the passage of paint therethrough. The plurality of apertures 16 also serve to preclude floating of the paint distributing plate 10. The apertures 16 are preferably arranged in a plurality of rows 18 with the apertures 16 disposed in each of the rows 18 being staggered in relation to the apertures 16 in adjacent rows 18 as illustrated in FIG. 3. This configuration of the apertures 16 permits even flow of paint through the paint distributing plate 10 to insure that the paint mixture remains homogeneous. This is especially important with paints having tinting agents added thereto.

Insertion of the paint distributing plate 10 into the paint bucket B divides the paint bucket B into a first open-ended compartment 20 and a second open-ended compartment 22. This division is effected since the lower edge 24 of the planar sheet 12 is in touching relationship with the base 26 of the paint bucket B and the side edges 28 of the planar sheet 12 are in direct contact with the arcuate sidewalls 30 of the paint bucket B.

The planar sheet 12 is locked into position within the paint bucket B by a combination of the engagement of the lower edge 24 and side edges 28 thereof with the paint bucket B and a pair of flanges 32 which extend outwardly from the planar sheet 12. The flanges 32 form a notch 34 between the side edges 28 of the planar sheet 12 and the flanges 32. The notches 34 capture portions of the lip 36 of the paint bucket B when the paint distributing plate 10 is inserted therein. Since the planar sheet 12 conforms closely in width to the arcuate sidewalls 30 of the paint bucket B and the lower edge 24 contacts the base 26 of the bucket B, the planar sheet 12 can not tilt once positioned within the bucket B and is therefore locked into a plane angularly disposed relative to the base 26 of the paint bucket B. The planar sheet 12 can be locked in position within the paint bucket B when it is placed therein in an angularly disposed plane in relation to the base 26 thereof as long as the planar sheet 12 has a width less than the diameter of the paint bucket B.

No amount of active wiping of a paint brush or paint roller against the smooth surface 14 will cause the paint distributing plate 10 to dislodge from the paint bucket B since the paint distributing plate 10 is effectively locked into position when inserted into the paint bucket B. Therefore, a rigid, fixed surface is provided to effectively aid in the distribution of paint upon a painting implement. Furthermore, if the paint bucket B is carried to a remote location such as the top of a ladder or scaffold the planar sheet 12 will not be permitted to move within the paint bucket B therefore precluding the splashing of paint therefrom or the disorientation thereof.

Figure 4:
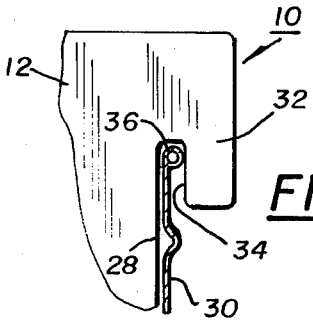
FIG. 4 is a partially broken away side view of the preferred embodiment engaging the lip of a paint can.

FIG. 4 clearly illustrates the manner in which the notches 34 formed by the flanges 32 engage the lip 36 of the paint bucket B. The notch 34 must merely accommodate the lip 36 and does not necessarily have to frictionally engage the same since the planar sheet 12 is locked into the position by a combination of the flanges 32 and the engagement of the edges of the planar sheet 12 by the arcuate sidewalls 30 of the paint bucket B as hereinbefore described.

Figure 5:
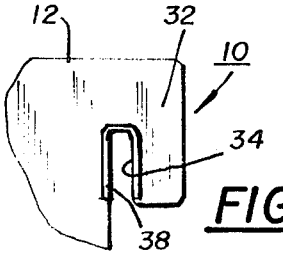
FIG. 5 is a fragmentary view of an alternate embodiment of the preferred embodiment.

FIG. 5 illustrates an alternate embodiment of the present invention wherein the flange 32 which forms the notch 34 is provided with a semi-resilient material 38 fixedly secured thereto. The semi-resilient material 38 may be plastic or spring metal and is provided to frictionally engage the lip 36 of the paint bucket B. Although the paint distributing plate 10 cannot be dislodged from its position when it is installed within the paint bucket B under ordinary circumstances, the plate 10 may be displaced from the bucket B if the bucket B is inverted. If evacuation of the paint distributing plate 10 from the bucket B is not desired when the bucket B is inverted, the employment of the semi-resilient material 38 for frictionally engaging the lip 36 of the bucket B will prevent the separation of the paint distributing plate 10 from the bucket B.

Figure 6:
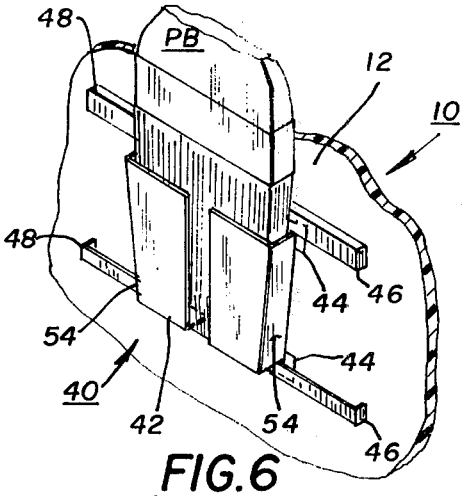
FIG. 6 is a pictorial representation of the paint brush storing receptacle of the present invention.
Figure 7:
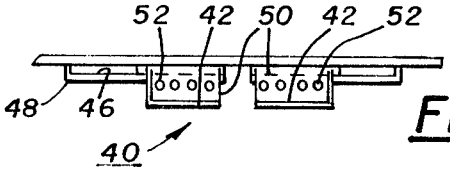
FIG. 7 is a top plan view of the preferred embodiment and the paint brush storing receptacle.

The paint distributing plate 10 may include a paint brush storage receptacle 40 illustrated in FIGS. 6 and 7. The paint brush storage receptacle 40 includes an open ended housing 42 which is bifurcated into two halves that are slidably mounted to the planar shape 12. The halves of the housing 42 each provide lateral flanges 44 that are engaged by the capturing portion 46 of a pair of tracks 48 with the lateral flanges 44 being slidable therein. As a result, the halves of the housing 42 may be slid in relation to each other to accommodate various sizes and types of paint brushes PB. The base 50 of the housing 42 preferably includes a plurality of drainage apertures disposed therethrough to permit drainage of paint accumulated on the paint brush PB into the bucket B. The lateral sidewalls 54 of the housing 42 are preferably tapered inwardly as illustrated to aid in the shaping of the paint brush PB. The tracks 48 may be integrally formed with the planar sheet 12 or may be fixedly secured thereto by any suitable means.

The planar sheet 12 is preferably constructed as an integral unit with the flanges 32 formed at the same time as the rest of the sheet 12. The planar sheet 12 is preferably constructed of a semi-resilient high impact material such as those formulations well known in the art which comprise styrene and butadiene. Since the planar shape 12 is formed of this semi-resilient high impact material, dry paint accumulating thereon can easily be removed therefrom by any impact delivered thereto. This impact will cause the dry paint to chip and flake from the paint distributing plate 10 without causing damage thereto.

This feature of the present invention greatly reduces "clean-up time" and adds to the overall versatility of the present invention. Although a material comprising styrene and butadiene is suggested, any other material having semi-resilient high impact characteristics may be employed.

Therefore, a primary advantage of the present invention is to provide a paint distributing plate for insertion into an open mouthed receptacle which is locked into position when inserted therein.

A further advantage of the present invention is to provide a paint distributing plate for insertion into an open mouthed receptacle wherein the plate will not float in the paint disposed within the receptacle.

A still further advantage of the present invention is to provide a paint distributing plate for insertion into an open mouthed receptacle which is ideally suited for distributing paint on both paint rollers and paint brushes.

Still another advantage of the present invention is to provide a paint distributing plate which includes means for storing paint brushes of various sizes and shapes.

Another further advantage of the present invention is to provide a paint distributing plate which permits passage of paint therethrough so that paint disposed within an open mouthed receptacle used in cooperation with the paint distributing plate will remain a homogeneous mixture.

Another still further advantage of the present invention is to provide a paint distributing plate which may be easily divested of accumulated dry paint.

Another advantage of the present invention is to provide a paint distributing plate which is simple in design, inexpensive to manufacture, and durable.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A paint distributing plate for insertion into an open mouthed receptacle providing a lip forming the mouth thereof and an arcuate sidewall comprising:

a planar sheet dimensioned for insertion into said receptacle, insertion of said sheet into said receptacle dividing said receptacle into two open-ended compartments;

means for positively locking said planar sheet in a selected position within said receptacle, said positive locking means comprising a pair of flanges extending outwardly from said planar sheet, said flanges forming a notch between said planar sheet and said flanges, said notches for capturing portions of said lip, said planar sheet providing side edges for contacting the interior of said arcuate sidewalls and a lower edge for contacting the bottom surface of said receptacle, said flanges and said side edges operably cooperating for locking said planar sheet in position; and a semi-resilient material disposed in said notches and fixedly secured to said planar sheet, said material for frictionally engaging said lip.

2. A paint distributing plate in accordance with claim 1, wherein said planar sheet provides at least one smooth surface.

3. A paint distributing plate in accordance with claim 1, wherein said paint distributing plate has a plurality of apertures disposed therethrough, said apertures permitting the flow of paint disposed within said receptacle between said two compartments.

4. A paint distributing plate in accordance with claim 3, wherein said apertures are disposed in a plurality of rows, said apertures in each row being staggered in relation to the apertures disposed in adjacent rows.

5. A paint distributing plate in accordance with claim 1, wherein said planar sheet is locked by said locking means in a plane angularly disposed relative to said bottom surface of said receptacle.

6. A paint distributing plate in accordance with claim 1, wherein said flanges are disposed in the same plane as said planar sheet.

7. A paint distributing plate in accordance with claim 1, wherein said flanges are integral with said planar sheet.

8. A paint distributing plate in accordance with claim 1, further comprising means for storing a painting implement.

9. A paint distributing plate in accordance with claim 8, wherein said storing means comprises an open-ended receptacle affixed to a surface of said planar sheet, said receptacle adapted to receive a painting implement.

10. A paint distributing plate in accordance with claim 9, wherein said receptable is bifurcated with the halves thereof slidably mounted on said surface, said halves being slidable in respect to each other to accommodate painting implements of varying sizes.

11. A paint distributing plate in accordance with claim 10, wherein said receptacle is slidably mounted to said surface by a plurality of tracks, said halves each providing lateral flanges engaged by said tracks and slidable therein.

12. A paint distributing plate in accordance with claim 9, further comprising a plurality of drain apertures disposed in the lowermost surface of said open-ended receptacle.

13. A paint distributing plate in accordance with claim 1, wherein said planar sheet is constructed of a semi-resiilent high impact material means for causing dried paint accumulating thereon to chip and flake off upon impact.

14. A paint distributing plate in accordance with claim 13, wherein said high impact material comprises styrene and butadiene.

15. A paint retaining and distributing apparatus comprising in combination:

an open mouthed bucket having a preselected diameter; a lip forming the mouth thereof and arcuate sidewalls; and a planar sheet dimensioned for insertion into said bucket, said sheet including a pair of flanges extending outwardly therefrom, said flanges forming a notch between said planar sheet and said flanges, said notches for capturing portions of said lip, said planar sheet dimensioned to provide side edges for contacting the interior of said arcuate sidewalls and a lower edge for contacting the bottom of said bucket, said flanges, said side edges, and said bottom edge operably cooperating for locking said planar sheet in position and dividing said receptacle into two open-ended compartments.

16. A paint distributing plate in accordance with claim 15, wherein said planar sheet provides at least one smooth surface.

17. A paint distributing plate in accordance with claim 15, wherein said paint distributing plate has a plurality of apertures disposed therethrough, said apertures permitting the flow of paint disposed within said receptacle between said two compartments.

18. A paint distributing plate in accordance with claim 17, wherein said apertures are disposed in a plurality of rows, said apertures in each row being staggered in relation to the apertures disposed in adjacent rows.

19. A paint distributing plate in accordance with claim 15, wherein said planar sheet is locked in a plane angularly disposed relative to said bottom surface of said receptacle.

20. A paint distributing plate in accordance with claim 15, wherein said flanges are disposed in the same plane as said planar sheet.

21. A paint distributing plate in accordance with claim 15, wherein said flanges are integral with said planar sheet.

22. A paint distributing plate in accordance with claim 15, further comprising means for storing a painting implement.

23. A paint distributing plate in accordance with claim 22, wherein said storing means comprises an open-ended receptacle affixed to a surface of said planar sheet, said receptacle adapted to receive a painting implement.

24. A paint distributing plate in accordance with claim 23, wherein said receptacle is bifurcated with the halves thereof slidably mounted to said surface, said halves being slidable in respect to each other to accommodate painting implements of varying sizes.

25. A paint distributing plate in accordance with claim 24, wherein said receptacle is slidably mounted to said surface by a plurality of tracks, said halves each providing lateral flanges engaged by said tracks and slidable therein.

26. A paint distributing plate in accordance with claim 23, further comprising a plurality of drain apertures disposed in the lowermost surface of said open-ended receptacle.

27. A paint distributing plate in accordance with claim 15, further comprising a semi-resilient material disposed in said notches and fixedly secured to said planar sheet, said material for frictionally engaging said lip.

28. A paint distributing plate in accordance with claim 15, wherein said planar sheet is constructed of a semi-resilient high impact material means for causing dried paint accumulating thereon to chip and flake off upon impact.

29. A paint distributing plate in accordance with claim 28, wherein said high impact material comprises styrene and butadiene.

30. A paint distributing plate for insertion into an open mouthed receptacle comprising:

a planar sheet dimensioned for insertion into said receptacle, insertion of said sheet into said receptacle dividing said receptacle into two open-ended compartments;

means for positively locking said planar sheet in a selected position within said receptacle; and means for storing a painting implement, said storing means comprising an open-ended receptacle affixed to a surface of said planar sheet, said receptacle adapted to receive a painting implement, said receptacle being bifurcated with the halves thereof slidably mounted to said surface, said halves being slidable with respect to each other to accommodate painting implements of varying sizes.

31. A paint distributing plate in accordance with claim 30, wherein said planar sheet provides at least one smooth surface.

32. A paint distributing plate in accordance with claim 30, wherein said paint distributing plate has a plurality of apertures disposed therethrough, said apertures permitting the flow of paint disposed within said receptacle between said two compartments.

33. A paint distributing plate in accordance with claim 32, wherein said apertures are disposed in a plurality of rows, said apertures in each row being staggered in relation to the apertures disposed in adjacent rows.

34. A paint distributing plate in accordance with claim 30, wherein said open-mouthed receptacle provides a lip forming the mouth thereof and arcuate sidewalls, said positive locking means comprising a pair of flanges extending outwardly from said planar sheet, said flanges forming a notch between said planar sheet and said flanges, said notches for capturing portions of said lip, said planar sheet providing side edges for contacting the interior of said arcuate sidewalls and a lower edge for contacting the bottom surface of said receptacle, said flanges and said side edges operably cooperating for locking said planar sheet in position.

35. A paint distributing plate in accordance with claim 34, wherein said planar sheet is locked by said locking means in a plane angularly disposed relative to said bottom surface of said receptacle.

36. A paint distributing plate in accordance with claim 34, wherein said flanges are disposed in the same plane as said planar sheet.

37. A paint distributing plate in accordance with claim 34, wherein said flanges are integral with said planar sheet.

38. A paint distributing plate in accordance with claim 30, wherein said receptacle is slidably mounted to said surface by a plurality of tracks, said halves each providing lateral flanges engaged by said tracks and slidable therein.

39. A paint distributing plate in accordance with claim 30, further comprising a plurality of drain apertures disposed in the lowermost surface of said open-ended receptacle.

40. A paint distributing plate in accordance with claim 30, wherein said planar sheet is constructed of a semi-resilient high impact material for causing dried accumulated thereon to chip and flake off upon impact.

41. A paint distributing plate in accordance with claim 40, wherein said high impact material comprises styrene and butadiene.

* * * * *